US006276288B1

(12) United States Patent
Hattori et al.

(10) Patent No.: US 6,276,288 B1
(45) Date of Patent: Aug. 21, 2001

(54) HEADGEAR FRAME

(75) Inventors: Osamu Hattori; Masahiko Ozeki, both of Ichinomiya (JP)

(73) Assignee: Kabushikikaisha Barudan, Ichinomiya (JP)

( * ) Notice: Subject to any disclaimer, the term of this patent is extended or adjusted under 35 U.S.C. 154(b) by 0 days.

(21) Appl. No.: 09/538,157

(22) Filed: Mar. 29, 2000

(30) Foreign Application Priority Data

Mar. 30, 1999 (JP) ..... 11-127519
Apr. 14, 1999 (JP) ..... 11-106168

(51) Int. Cl.[7] ..... D05C 9/04
(52) U.S. Cl. ..... 112/103; 112/470.14; 112/475.11
(58) Field of Search ..... 112/103, 102.5, 112/470.06, 470.14, 470.17, 470.29, 470.09, 63, 475.11

(56) References Cited

U.S. PATENT DOCUMENTS 5,832,853 * 11/1998 Pokrishevsky et al. ..... 112/475.11

* cited by examiner

*Primary Examiner*—Peter Nerbun
(74) *Attorney, Agent, or Firm*—Pillsbury Winthrop LLP

(57) ABSTRACT

A headgear frame comprises: a cylindrical receiving frame adapted to be fitted in a headgear; and a holding band adapted to be wound on the outer side of the headgear for clamping the headgear between itself and the receiving frame. At least one of one end and the other end of the holding band is hinged or hooked at a position apart from the receiving frame to the outer circumference. Push members projected toward the receiving frame are provided in at least one of the vicinities of the one end and the other end, as apart from the receiving frame, of the band edge of the holding band. Corresponding portions of the headgear when clamped are pushed and tensed by the push members so that they may not float from the receiving frame.

3 Claims, 5 Drawing Sheets

HEADGEAR FRAME

BACKGROUND OF THE INVENTION

1. Field of the Invention

The present invention relates to a headgear frame for a sewing machine for embroidering the peripheral portion of a headgear.

2. Description of the Related Art

A conventional headgear frame 100 for a sewing machine is provided, for example, with a receiving frame 101 formed into a cylindrical shape and a holding band 102 having a belt shape, as shown in FIG. 5.

When a headgear 1 is to be embroidered, first of all, the receiving frame 101 of the headgear frame 100 is mounted on the (not-shown) set jig. The headgear 1 is fitted on the outer circumference of the receiving frame 101 and is then clamped and fixed on its outer circumference by the holding band 102 of the headgear frame 100.

At this time, one end 102*a* of the holding band 102 is hinged at a position apart from the receiving frame 101 to the side of the outer circumference, whereas the other end 102*b* of the holding band 102 is hooked at a position apart from the receiving frame 101 to the side of the outer circumference. As a result, the vicinities 1*b* of the left and right ends of the headgear 1, which are held by the vicinities of the one end 102*a* and the other end 102*b* of the holding band 102, are not sufficiently held so that they easily float from the receiving fame 101 and wrinkle. Since embroidered patterns are not neatly formed unless the vicinities 1*b* of the left and right ends of the headgear 1 are sufficiently tensed, the wrinkles must be smoothed out, which requires experience and takes a long time.

SUMMARY OF THE INVENTION

An object of the present invention is to provide a headgear frame capable of clamping a headgear without any wrinkle.

In the invention, therefore, there is adopted the following means, as will be individually described with reference to FIGS. 1 to 4.

According to an aspect of the invention, there is provided a headgear frame 10 comprising: a cylindrical receiving from 11 adapted to be fitted in a headgear 1; and a holding band 12 adapted to be wound on the outer side of the headgear 1 for clamping the headgear 1 between the holding band 12 and the receiving frame 11, wherein at least one of one end 12*a* and the other end 12*b* of said holding band (12 (e.g., both of one end 12*a* and the other end 12*b* in a shown embodiment) is hinged or hooked at a position apart (by a distance indicated by arrow S) from the receiving frame 11 to the outer circumference, characterized: in that push members 13 projected toward the receiving frame 11 are provided in at least one (e.g., both in the shown embodiment) of the vicinities of the one end 12*a* and the other end 12*b*, as apart from the receiving frame 11, of the band edge (e.g., the band edge on this side in the shown embodiment) of the holding band 12; and in that corresponding portions 2 of the headgear 1 when clamped are pushed and tensed by said push members 13 so that they may not float from the receiving frame 11.

The headgear 1 includes a cap, a hat, a beret and any others which can be embroidered and worn on the head.

The push members 13 can be exemplified by either a mode (FIG. 2 or 3), in which a plurality of push members 13 are raised stepwise toward the one end or the other end, or a mode (FIG. 4) in which generally triangular push members 13 are raised gradually toward the one end or the other end.

The headgear 1 is clamped on the headgear frame 10 in the following manner:

The headgear frame 10 is set on the (not-shown) set jig;

The other end 12*b* of the holding band 12 is released from the receiving frame 11 of the headgear frame 10;

The headgear 1 is mounted, while its next-to-skin portion 3 is being peeled out, on the receiving frame 11. At this time, the stitched portion with saw-toothed projections 14 of the receiving frame 11 (so as to prevent dislocations);

When the headgear 1 is to be fixed with the holding band 12, the visor 4 of the headgear 1 is inserted at first into an opening 15 of the band central portion; and The corresponding portions 2 (i.e., the left and right end portions in the shown embodiment) of the headgear 1 are so pushed and tensed by the push members 13 at the end portions of the holding band 12 that they are not wrinkled, and the other end 12*b* of the holding band 12 is hooked and fixed.

The following effects can be obtained according to this headgear frame 10;

The headgear 1 is smoothed out at its left and right end portions so that its setting time is shortened; and The headgear 1 can be decoratively embroidered even at both end portions of the embroidered range (e.g., a horizontal range of 270 degrees).

Further objects of this invention will become evident upon an understanding of the illustrative embodiments described below. Various advantages not specifically referred to herein but within the scope of the instant invention will occur to one skilled in the art upon practice of the presently disclosed invention. The following examples and embodiments are illustrative and not seen to limit the scope of the invention.

DETAILED DESCRIPTION OF THE PREFERRED EMBODIMENTS

Figure 1:
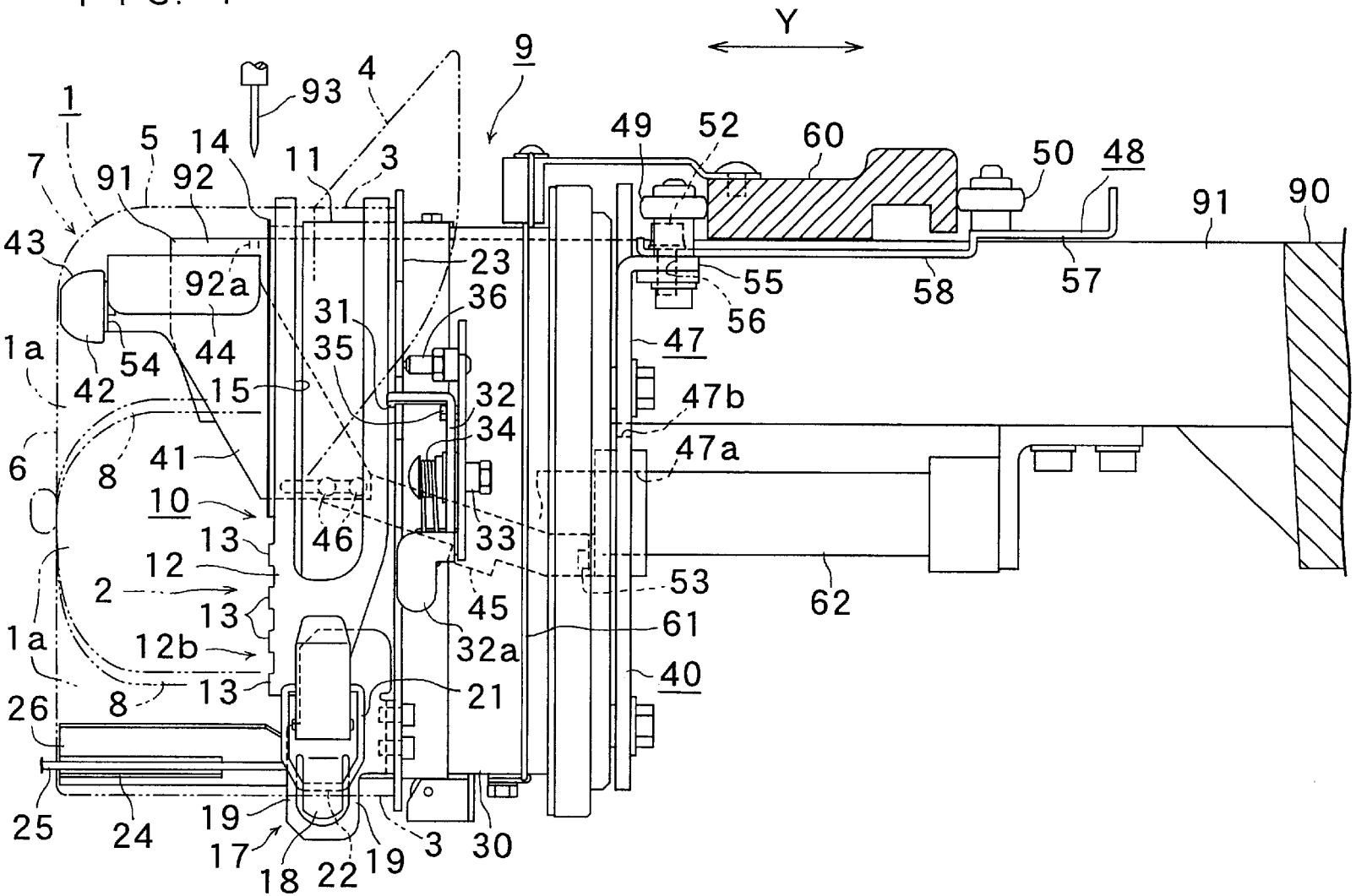
FIG. 1 is a righthand side view showing a headgear frame for a sewing machine according to an embodiment of the invention.
Figure 2:
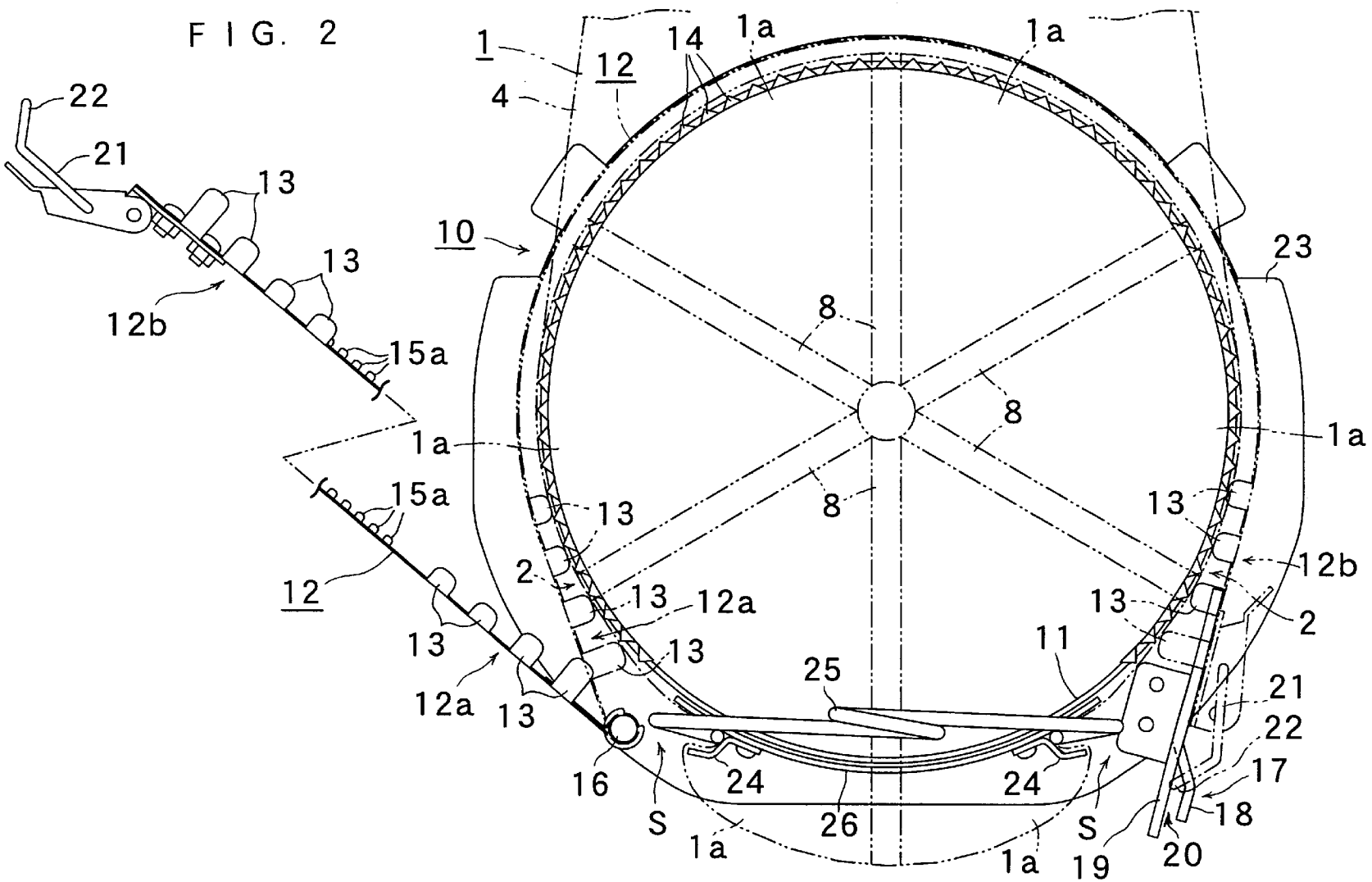
FIG. 2 is a front view of the same headgear frame.
Figure 3:
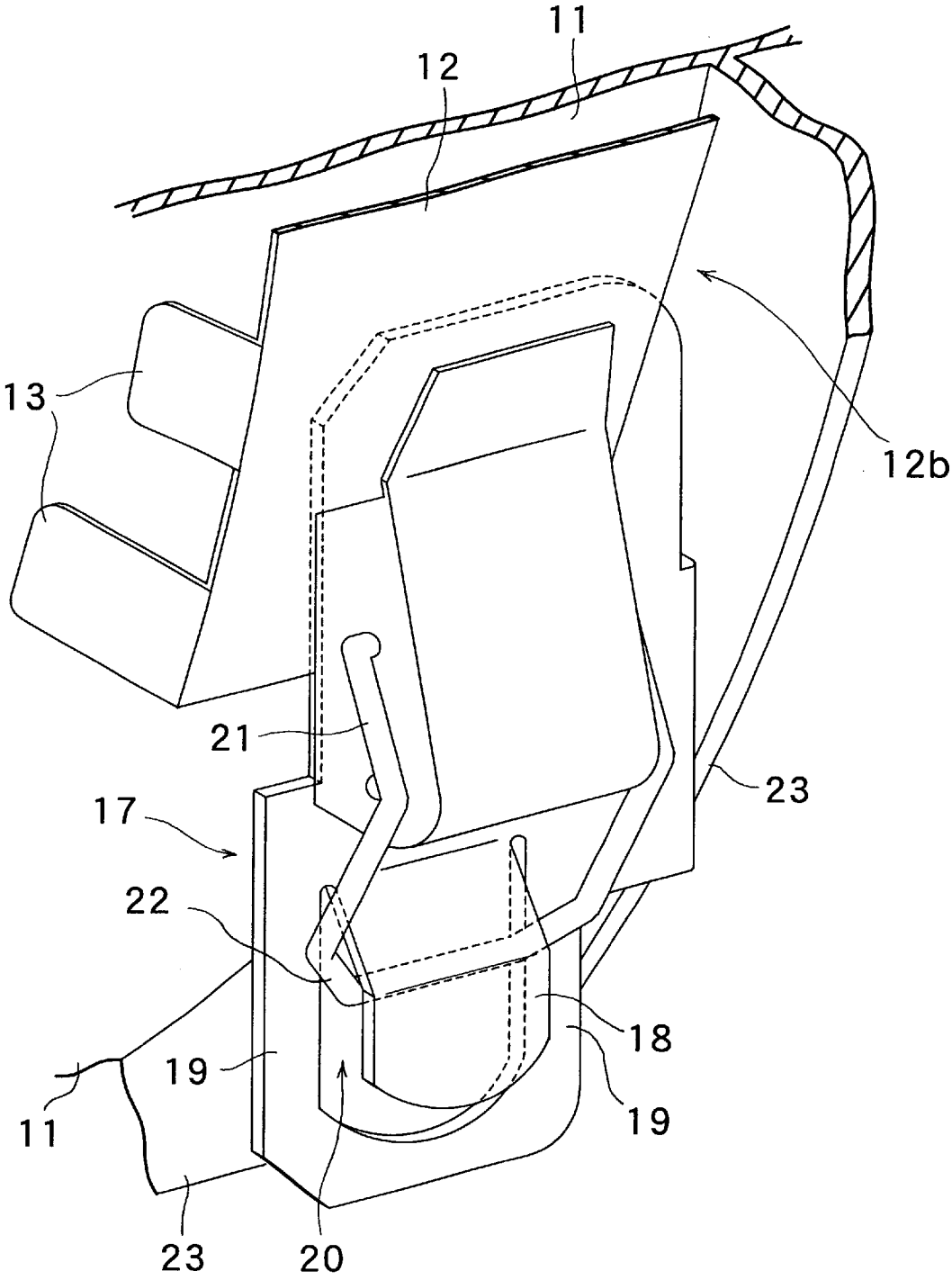
FIG. 3 is a perspective view of the vicinity of a hooking portion of the same headgear frame.
Figure 4:
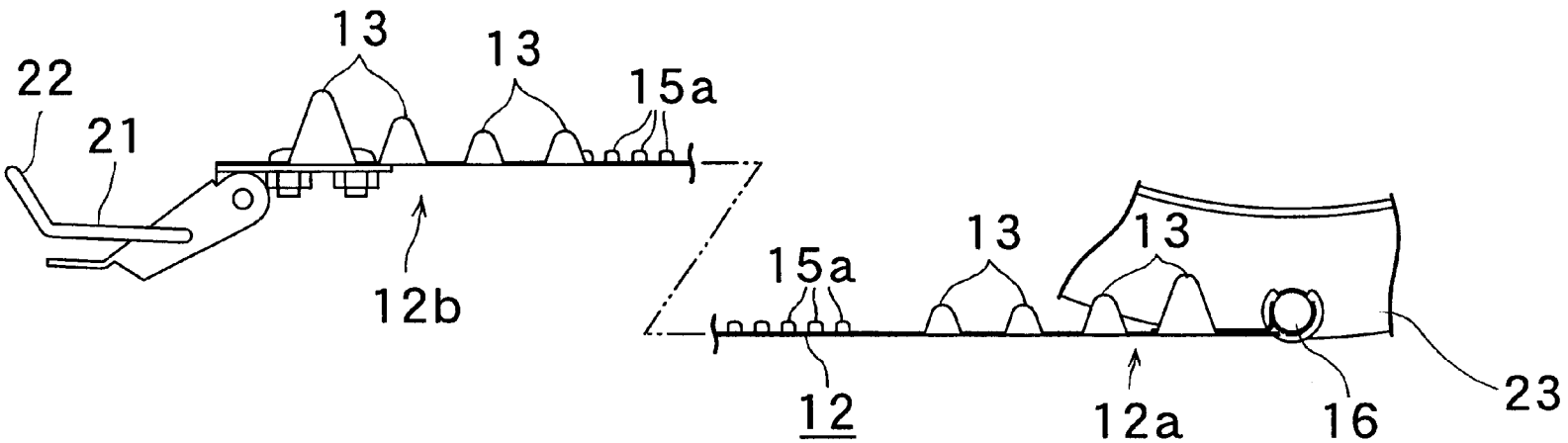
FIG. 4 is a partial front view showing a modified embodiment of the same headgear frame.
Figure 5:
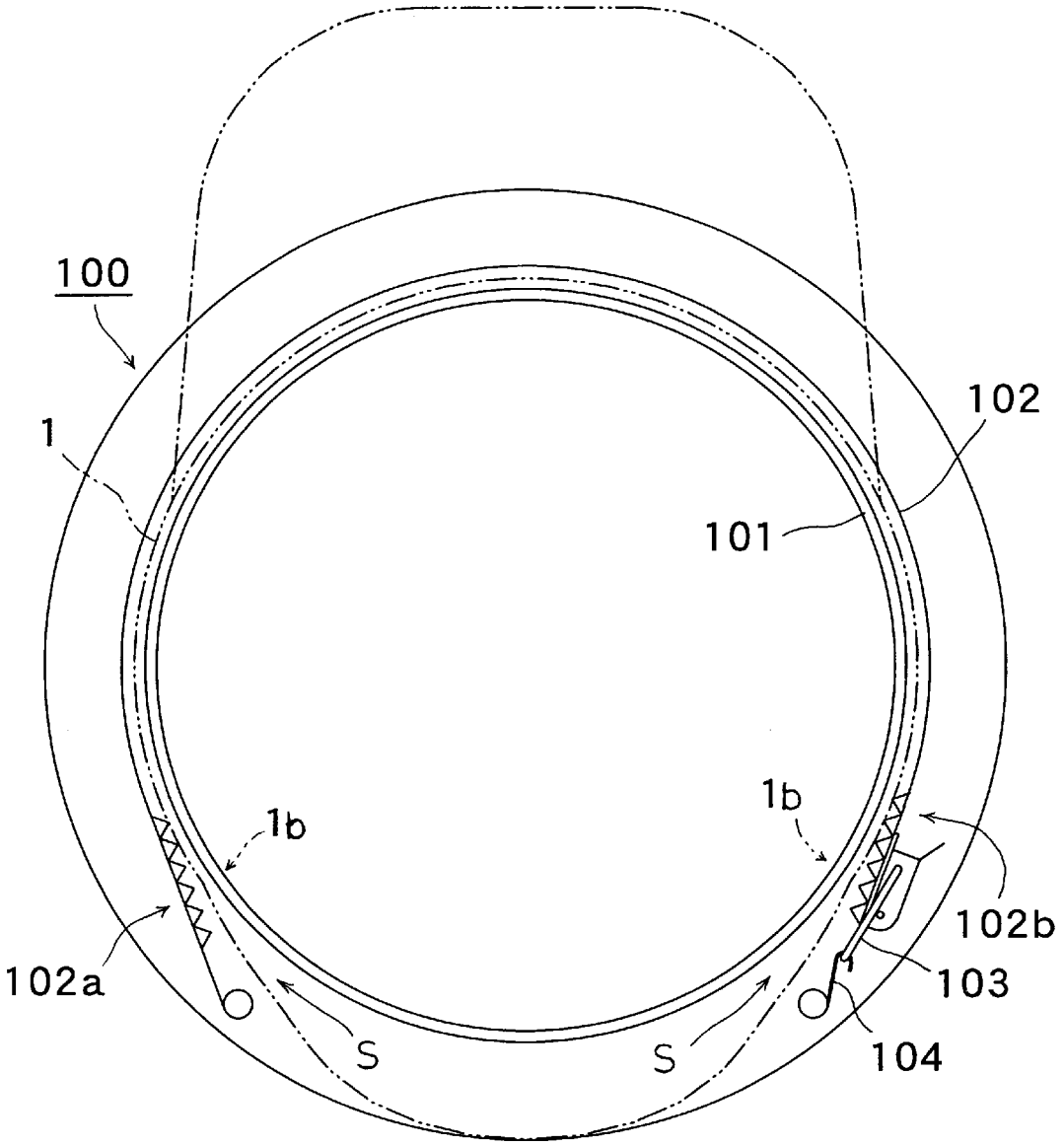
FIG. 5 PRIOR ART
FIG. 5 is a front view showing a conventional headgear frame.

FIGS. 1 to 3 show a headgear frame 10 for a sewing machine according to an embodiment of the invention. As shown in FIG. 1, this sewing machine is provided with a cylindrical bed 91 which is projected in parallel with a direction, as indicated by arrow Y. from a machine frame 90. Below and in parallel with the root end side of the cylindrical bed 91, there is projected a guide rail 62 which supports a headgear frame apparatus 9 including the headgear frame 10 in a manner to move in the direction Y. Over the cylindrical bed 91, there is further provided a horizontal drive frame 60 which extends in a horizontal plane in the (not-shown) direction X intersecting the direction Y at a right angle, so that the headgear frame apparatus 9 is moved by the horizontal drive frame 60.

On the upper face of the leading end side of the cylindrical bed 91, there is arranged a throat plate 92 which is provided with a needle eye 92*a* and below which there is packaged a (not-shown) hook wound with a bobbin thread. Over the cylindrical bed 91, there is provided a needle 93 which is made vertically movable in the (not-shown) machine head. And, a headgear (cap) 1, as held on the headgear frame apparatus 9, is embroidered by the association between the needle 93 to be driven on the basis of embroidering data and the aforementioned hook.

The headgear frame apparatus 9 is provided for supporting the embroidering range of the headgear 1 in a proper position just over the cylindrical bed 91. The headgear frame apparatus 9 is constructed to include: a support frame 40 made slidable in the direction Y along the guide rail 62; a rotary drive frame 30 so supported on the support frame 40 as to rotate on an axis parallel to the direction Y; the headgear frame 10 clamping the headgear 1 and replaceably engaged to outside of the rotary drive frame 30; elastic plates 41 mounted on a stay 45, as projected forward from the support frame 40, and extended sideways (to the left and right sides in the shown embodiment) of the cylindrical bed 91; and auxiliary rollers 42 provided rotatably at the leading ends of the elastic plates 41 and rotating in abutment against boundary corner portion 7 between a circumferential portion 5 and a crest portion 6 of the headgear 1 clamped by the headgear frame 10.

This headgear frame 10 is provided, as shown in FIGS. 1 to 3, with a cylindrical receiving frame 11 to be inserted into the headgear 1, and a holding band 12 adapted to be wound on the outer side of the headgear 1 to clamp the headgear 1 between itself and the receiving frame 11.

This receiving frame 11 is provided with a brim 23 disposed generally at the center of its longitudinal direction. On the front face of the brim 23, there are provided a hinging portion 16 and a hooking portion 17 which are spaced from each other in the circumferential direction of the receiving frame 11.

The hinging portion 16 and hooking portion 17 are individually disposed at positions spaced apart from the outer circumference of the receiving frame 11 (by a distance indicated by arrow S). To the hinging portion 16 near the receiving frame 11, there is hinged one end 12*a* of the holding band 12, the other end 12*b* of which is removably hooked on the hooking portion 17 near the receiving frame 11.

Of the band edge (i.e., the band edge on this side in the shown embodiment) of the holding band 12, both portions in the vicinities of the one end 12*a* and the other end 12*b* apart from the receiving frame 11 are provided with push members 13 which are projected toward the receiving frame 11. By these push members 13, the headgear 1 is so pushed and tensed, when clamped, at its corresponding portions 2 that it may not float from the receiving frame 11. The push members 13 are a plurality of push members 13 which are raised stepwise toward the one end or the other end.

In the holding band 12, there is formed a horizontally elongated opening 15 for passing the visor 4 of the headgear 1 therethrough. On the intermediate portion of the front edge of the opening 15, there are formed a number of saw-toothed projections 15*a* which can bite into the stitched portion between the visor 4 and the circumferential portion 5 of the headgear 1 from the outer side of the headgear 1.

At the hooking portion 17 near the receiving frame 11 and at the other end 12*b* of the holding band 12, respectively, as shown in FIG. 3, there are provided a combination of a hooking member 18 and a pair of regulating members 19 which make a V-shaped angled side face 20 with the hooking member 18 on both sides of the hooking member 18, and a ring 21 hooked by the hooking member 18. When the ring 21 is hooked by the hooking member 18, it bites into the V-shaped angled side face 20 so that it does not go out of position with respect to the hooking member 18 (especially in the band width direction). The ring 21 is provided at its leading end with a C-shaped portion 22. Here, this C-shape includes one which curves smoothly and one which is squarish and bends. The hooking member 18 is made substantially as wide as the internal width of the C-shaped portion 22, and the clearance of the paired regulating members 19 is made substantially as wide as the external width of the C-shaped portion 22.

At the receiving frame 11, a curved plate 26 is projected forward of the receiving frame 11 along the inner circumferential edge of the front end of the receiving frame 11, and a support plate portion of the curved plate 26 is projected forward of the receiving frame 11 on the outer circumference of the receiving frame 11 between the hinging portion 16 and the hooking portion 17. The curved plate 26 is provided at its front end edge with a number of projections 14 which are so arranged as can bite into the stitched portion with the circumferential portion 5 of a next-to-skin portion 3. The support plate portion is provided on its outer circumference with a pair of fitting members 24 which are spaced from each other in the circumferential direction of the receiving frame 11. This support plate portion is inserted into the headgear 1 to clamp the back side of the headgear 1 between the support plate portion and a holding clip 25 which is fitted in the fitting members 24 from the outer side of the headgear 1.

Next, the headgear 1 is clamped by the headgear frame 10 thus constructed in the following manner:

(1) The headgear frame 10 is set in the (not-shown) set jig;

(2) The other end 12*b* of the holding band 12 is released from the receiving frame 11 of the headgear frame 10;

(3) The headgear 1 is mounted on the receiving frame 11 while peeling out the next-to-skin portion 3. The headgear 1 is positioned to have its back side located on the side of the support plate portion of the receiving frame 11. At this time, the stitched portion of the headgear next-to-skin portion is made to engage with the saw-toothed projections 14 of the receiving frame 11 (so as to prevent dislocations);

(4) When the headgear 1 is fixed by the holding band 12, the visor 4 of the headgear 1 is inserted at first into the opening 15 at the band central portion, and the holding band 12 is wound on the headgear 1;

(5) The push members 13 at the both end portions of the holding band 12 push and tense the corresponding portions 2 (i.e., the left and right end portions in the shown embodiment) of the headgear 1 so that the corresponding portions 2 may not float from the receiving frame 11, and the other end 12*b* of the holding band 12 is hooked and fixed while eliminating the wrinkles; and (6) Moreover, the back side of the headgear 1 is lightly pulled downward by one hand to tense the left and right end portions of the headgear 1, and the holding clip 25 is mounted in the fitting members 24 through the headgear 1 by the other hand.

The following effects can be achieved according to the headgear frame 10:

i) The left and right end portions of the headgear 1 are easily smoothed out to shorten the setting time of the headgear 1; and ii) The both end portions of the embroidering range (e.g., the horizontal range of 270 degrees) of the headgear 1 are tensed so that even the both end portions can be decoratively embroidered.

Here, the invention should not be limited to the aforementioned construction of the embodiment but can be embodied by modifying it suitably without departing from the gist thereof, as in the following:

(1) The invention can be modified by a mode in which the push members 13 are formed into a generally triangular shape and raised gradually toward one end or the other end;

(2) The invention is applied to the headgear frame 10, in which either of the one end 12*a* or the other end 12*b* of the holding band 12 is hinged or hooked at a position apart from the receiving frame 11 toward the outer circumference, and the vicinity of either one end 12*a* or the other end 12*b* apart from the receiving frame 11 is provided with the push members 13 projected toward the receiving frame 11; and (3) The fitting members 24, the holding clip 25 and the curved plate 26 are omitted.

As many apparently widely different embodiments of this invention may be made without departing from the spirit and scope thereof, it is to be understood that the invention is not limited to the specific embodiments thereof except as defined in the appended claims.

What is claimed is:

1. A headgear frame, comprising:

a cylindrical receiving frame adapted to be fitted in a headgear; and a holding band adapted to be wound on the outer side of the headgear for clamping the headgear between the holding band and the receiving frame, at least one of a first end and a second end of said holding band being hinged or hooked at a position spaced apart from the outer circumference of the receiving frame, wherein push members project toward the receiving frame in at least one of the vicinities of the first end and the second end, as apart from the receiving frame, of a band edge of the holding band and corresponding portions of the headgear when clamped are pushed and tensed by said push members so that they may not float from the receiving frame.

2. A headgear frame according to claim 1, wherein said push members are a plurality of push members raised stepwise toward the first end or the second end.

3. A headgear frame according to claim 1, wherein said push members are a plurality of generally triangular push members raised gradually toward the first end or the second end.

* * * * *